US006277153B1

(12) United States Patent
Van Kouwen et al.

(10) Patent No.: US 6,277,153 B1
(45) Date of Patent: Aug. 21, 2001

(54) DETERGENT COMPOSITION AND LAUNDRY WASHING METHOD

(75) Inventors: Eddy Petrus Van Kouwen; Frederik Jan Schepers; Rudolf Comelis Verheul; Wilhelm Ewald Smit, all of Maarssen (NL)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/615,514

(22) Filed: Jul. 13, 2000

(30) Foreign Application Priority Data

Jul. 14, 1999 (EP) ..... 99202312

(51) Int. Cl.[7] ..... D06F 17/00; C11D 7/38; C11D 7/54

(52) U.S. Cl. ..... 8/137; 510/277; 510/283; 510/306; 510/310; 510/313; 510/370; 510/374; 510/376

(58) Field of Search ..... 510/277, 283, 510/306, 310, 313, 370, 374, 376; 8/137

(56) References Cited

U.S. PATENT DOCUMENTS 5,244,594 * 9/1993 Favre et al. ..... 252/186.33
5,290,474 * 3/1994 Clarkson et al. ..... 252/174.12
5,853,430 * 12/1998 Shindo et al. ..... 8/137
6,162,782 * 12/2000 Clarkson et al. ..... 510/320

* cited by examiner

*Primary Examiner*—Gregory Delcotto

(57) ABSTRACT

A chemical cleaning system for a multi-tank or a single-tank laundry washing machine, having at least two separate components for aqueousdissolution or dilution to respective use concentrations, a first component comprising a proteolytic enzyme, and a second component comprising an imidoperoxycarboxylic acid, particularly phthaloylaminoperoxycaprbic acid (PAP), wherein the first component is introduced into a prewash zone or step, and the second component is introduced into a main wash zone or step. When using this system, it was found that effective cleaning could be obtained even at relatively low main wash temperatures of 45–55° C.

As a result, much less energy was needed and a considerable reduction of textile damage was observed as compared with cleaning systems of the prior art.

3 Claims, 1 Drawing Sheet

DETERGENT COMPOSITION AND LAUNDRY WASHING METHOD

FIELD OF THE INVENTION

The present invention relates to cleaning compositions and their use in laundry washing machines, especially in industrial Washer Extractors (WE) or Continuous Batch Washers (CBW) having multiple prewashing, washing and rinsing zones or steps.

BACKGROUND OF THE INVENTION

A wash process in a conventional Washer Extractor consists of several steps, including one or more prewash, wash and rinse steps. These steps are carried our consecutively.

A conventional CBW consists of separate prewash, wash and rinse zones. Fresh water is introduced into the rinse zone of the machine and is passed cascade-fashion toward the mainwash zone while the laundry is transported in a countercurrent direction. These steps are carried out sequentially while the wash load is transported.

The detergent compositions used in such machines generally comprise products such as a prewash product, a main wash product, a bleach product and a neutralising product. Also one or more additional products, boosters, could be added to the process to enhance the detergency.

Typical product ingredients are surfactants, sequestering agents, such as phosphates, alkalinity salts, and bleaching agents.

Usually applied bleaching agents are hypochlorite, hydrogen peroxide and peracetic acid.

Contact time of the cleaning composition with the laundry in CBW's is typically quite short, e.g. about 1 to 2 minutes per wash segment.

The cleaned laundry is generally rinsed in a final rinse.

A problem observed when using the above-mentioned generally applied bleaching ingredients is the resulting considerable textile damage, occurring after multiple washings.

The main reason is considered to be the aggressive conditions in the wash for the textile. Both the wash temperatures (of generally 70–90° C.) and the pH are high and the bleaching agents aggressive. These conditions are necessary to obtain adequate cleaning performance and hygiene.

Besides the negative impact on the textile, there are also other negatives associated with the high temperatures applied in the known CBW's of the prior art:

the wash processes require a high amount of energy.

washing polyester cotton textile requires a specific and additional step to the wash process, called cool-down, to prevent creasing of the textile. Over a specific period of time colder water needs to be added to the wash to slowly cool the temperature to below 50° C. This additionally increases wash times and requires more water.

The aggressive products used are difficult to rinse out and high amounts of water in the rinse are required to eliminate these products from the textile.

Not all articles can withstand these high temperatures. In particular, colour damage may easily occur.

Effluant temperatures are high which is often not tolerated by authorities for environmental reasons. Authorities insist more and more on low temperatures of the effluent before it may enter any sewage system.

We have now surprisingly found that these and other problems can be overcome, when applying a cleaning system having (in addition to a main wash product and a neutraliser) at least two separate components, a first component comprising a proteolytic enzyme and a second component comprising an imidoperoxycarboxylic acid bleach ingredient according to the present invention, wherein the first component is introduced into a prewash zone or step, and the second component is introduced into a main wash zone or step. These components are effectively used together with a main wash product and a neutraliser. An optional booster could also be added.

DEFINITION OF THE INVENTION

Consequently, according to a first aspect the present invention provides a chemical cleaning system for a multi tank or a single-tank laundry washing machine having at least 2 separate components for aqueous dissolution or dilution to respective use concentrations, a first component comprising a proteolytic enzyme, and a second component comprising an imido-peroxycarboxylic acid having the formula (I):

(I)

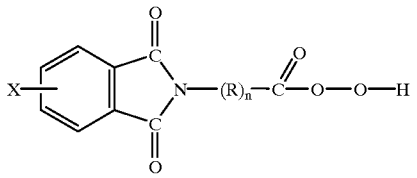

wherein

X is H, a halogen or a carboxyl group in any position on the aromatic ring;

R is a straight or branched chain lower alkylene having 1–4 carbon atoms; and n is an integer in the range from 1–12, wherein the first component is introduced into a prewash zone or step, and the second component is introduced into a main wash zone or step.

A highly effective method of laundrywashing in a multi-tank (CBW) or single-tank (WE) industrial laundry washing machine is also described, said method comprising the steps of:

(i) formulating at least two separate components of a chemical cleaning system for aqueous dissolution or dilution to respective use concentrations, a first component comprising a proteolytic enzyme, and a second component comprising an imidoperoxycarboxylic acid of formula (I) (as defined in claim 1);

(ii) introducing the first component into a prewash zone or step, to clean dirty laundry;

(iii) introducing the second component into a main wash zone or step, to effectively complete the cleaning of the laundry.

DETAILED DESCRIPTION OF THE INVENTION

When using the system of the present invention, it was found that effective cleaning performance could be obtained even when applying relatively low temperatures in the wash sections or steps. These temperatures are preferably in the range of from 30–70° C., more preferably 45–55° C., whereas main wash temperatures applied when using the cleaning systems of the prior art are in the range of approximately 70–90° C.

Furthermore, relatively moderate pH conditions , i.e. pH-values in the range of 7–10, preferably 8.5–9.5, are effectively applied in the main wash sections or steps when using the system of the present invention.

It was found that in spite of these moderate conditions, favourable results in respect of detergency, cleaning and bleaching of the treated laundry could still be obtained.

As a result, much less energy was needed and the temperature of the effluent was much lower as compared with the known cleaning system of the prior art, while similar cleaning, detergency, disinfection and bleaching performance was obtained.

Furthermore, a surprising reduction in textile damage was found as compared to the damage observed when applying said known cleaning systems.

In addition, cool-down steps for polyester cotton textiles could be eliminated generating advantages for processing time and reduction in water.

Enzymatic Component

The proteolytic enzymes usable in the system of the present invention are, for example, the subtilisins which are obtained from particular strains of B. subtilis and B. licheniformis, such as the commercially available subtilisins Maxatase, supplied by Gist-Bracades N.V., Delft, Holland, and alcalase, supplied by NOVO Industri A/S, Copenhagen, Denmark.

Particularly suitable are proteases obtained from a strain of Bacillus having maximum activity throughout the pH-range of 8–12, being commercially availabe from NOVO Industri A/S under the tradenames of Esperase and Savinase. The preparation of these and analogue enzymes is described in GB patent No. 1,243,784. These enzymes are generally presented as granules, e.g. marumes, prils, T-granulates, etc., or liquids and may have enzyme activity of rom 500 to 6,000 Glycine Units/mg. The proteolytic enzyme activity can be determined by the method as described by M. L.Anson in "Journal of general physiology", Vol. 22 (1938), page 79 (one Anson unit/gram= 733 Glycine Units/milligram).

In the compositions of the invention, proteolytic enzymes may be present in amounts such that the final use composition of the enzyme component has proteolytic enzyme activity of from about 10 to $10^{10}$ Glycine Units/kilogram, preferably from $10^2$ to $10^{10}$ and more preferably $10^4$ to $10^9$.

In order to obtain a suitable activity of the proteolytic enzyme, the temperature applied in the prewash zone or step into which the first component containing this enzyme is introduced, is preferably in the range of 30–40° C. For the same reason, the pH of that prewash zone or step is desirably in the range of 9–11.

Bleaching Ingredient

It was found that imidoperoxycarboxylic acids of formula (I) show very effective bleaching and disinfecting properties already at relatively low temperatures, in the range of 30–70° C.

Preferably, the imidoperoxycarboxylic acid is a compound of formula (I) wherein R is a CH2-group and n is an integer ranging from 3–8. More preferably, the imidoperoxycarboxylic acid is phthaloylaminoperoxycaproic acid (PAP) having the formula (II):

(II)

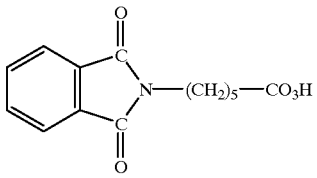

The effective use concentration of this bleach compound is determined by the degree of soiling of the laundry to be cleaned as well as the hygiene to be obtained.

In actual practice, the use concentration of the imidoperoxycarboxylic acid of the present invention in the main wash step or zone into which the second component is introduced, is adjusted to be in the range of 1–2 grams/liter water.

BRIEF DESCRIPTION OF DRAWINGS

Experimental Method

Test were carried out in a multi-tank Continuous Batch washer (CBW), as shown in FIG. 1.

Figure 1:
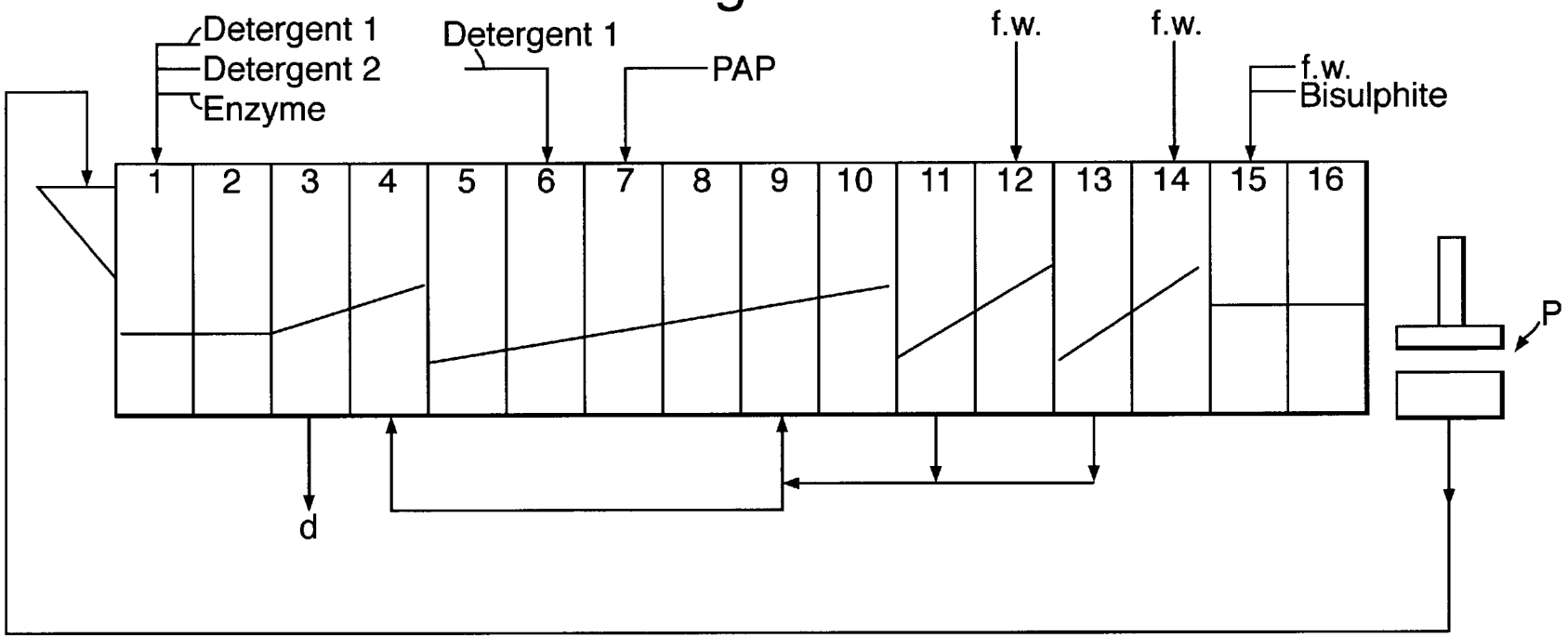

The capacity of this CBW is 970 kg laundry/hr, whereas the contact time between the laundry and the wash liquor is 130 seconds in each compartment of this CBW.

As can be seen in FIG. 1, this CBW comprises 16 compartments or zones of which:

zones 1–4 are prewashing compartments zones 5–10 are main washing compartments zones 11–14 are rinse compartments zones 15–16 are neutralising compartments.

When this CBW is in operation, fresh water—indicated in FIG. 1 as "f.w."— is introduced into rinse compartments 12 and 14 (at feed rates of 4.7 $m^3$/hr respectively 1.8 $m^3$/hr) and neutralising compartment 15 (at a feed rate of 2.0 $m^3$/hr).

This water is cascaded toward the prewashing compartments where it is drained, while the laundry is transported in counter-current direction.

At the end of the CBW, there is a laundry press (schematically indicated in FIG. 1 as "p") where the cleaned laundry is dried. The water coming out of this press is recirculated toward the laundry entrance where it is reused. Furthermore, compartment 3 contains a drain, indicated by "d".

During the test, the following detergent products were applied:

"Detergent 1", which is a standard liquid detergent for hard water applications. "Detergent 1" was fed into compartments 1 and 6, at a feed rate of 9 gr/kg laundry respectively 3 gr/kg laundry;

"Detergent 2", which is another liquid detergent. "Detergent 2" was fed into compartment 1, at a feed rate of 2 gr/kg laundry.

The compositions of these products is shown below:

| | Detergent 1 (% wt) | | Detergent 2 (% wt) |
|---|---|---|---|
| Nonionic | 10.0 | Fatty acid | 56.0 |
| KOH | 12.2 | Nonionic | 7.5 |
| Sodium triphosphate | 10.0 | Isopropanol | 12.5 |

-continued

| | Detergent 1 (% wt) | | Detergent 2 (% wt) |
|---|---|---|---|
| Neutral silicate | 5.1 | KOH | 2.9 |
| Minors | 2.1 | Water | up to 100.0 |
| Water | up to 100.0 | | |

In addition, an aqueous solution containing 40% bisulphite (acting as a neutraliser) was dosed into compartment 15, during the tests, at a feed rate of 2.0 gr/kg laundry.

EXAMPLE 1

In this example, experiments were carried out on the CBW shown in FIG. 1 using the experimental method outlined above, in order to test the performance of the system of the present invention.

In the tested system, an aqueous solution of savinase (being a protease enzyme, ex NOVO) was dosed into compartment 1 such that the enzyme dosage was 0.08 gram per kg laundry. In addition, phthaloylaminoperoxycaproic acid (PAP) was dosed—either contained in an aqueous liquid or as granules—into compartment 7, at a feed rate of 1.66 gram PAP/kg laundry.

The temperature applied in compartment 7 was 45° C.

The performance of the system of the invention was tested with regard to non-specific soil activity, bleachable soil activity, enzyme effect on proteinaceous soil and blood stain removal activity.

For these tests, the following test cloths were used as test monitors:

Non specific soil activity: Empa 101, WFK-20D;

Enzyme effect on proteinaceous soil: Empa-116, Empa-117, AS-10, PC-10;

Bleachable soil activity: BC-10, BC/PC-1, Sunak, Empa-114;

Blood stain removal activity: Empa-111.

These test monitors are standard available:

Empa from Empa Switzerland; Sunak from TNO, Netherlands;

WFK from Wasscherei Forschung Krefeld; and the others from CFT, Netherlands.

After a full cleaning cycle in the CBW, reflectance measurements were carried out on these test monitors using a standard Micromatch 2020 at a frequency of 460 Nm with a standard light source.

The following results—in terms of the percentage light reflected by the tested test monitors, at 460 Nm—were obtained:

-continued

| | |
|---|---|
| Non-specific soil activity: | |
| Empa-101 | 45.7 |
| WFK-20D | 72.7 |
| Bleachable soil activity: | |
| Sunak | 59.4 |
| BC-1 | 62.7 |
| Empa-114 | 71.3 |
| Enzyme effect on proteinaceous soil: | |
| Empa-116 | 57.6 |
| Empa-117 | 65.1 |
| AS-10 | 63.5 |
| PC-10 | 76.0 |
| Blood stain removal activity: | |
| Empa-111 | 85.0 |

These results show adequate performance of the tested system, which is similar to that of prior art systems, using $H_2O_2$ or peracetic acid in stead of the "PAP"— liquid/granules in combination with the protease enzyme. This is surprising in view of the much lower temperature applied in the tested sytem (45° C.) as compared to the temperature used in the wash compartments of these most commonly used prior art systems (85° C.).

EXAMPLE 2

Comparative Examples A, B

In order to avoid batch-to-batch variations which occur in test cloth preparation, a second series of experiments was carried out wherein a system of the invention was compared with a system of the prior art.

Also in these experiments, tests were carried out on the CBW schematically shown in FIG. 1 using the experimental method described above.

First, a known system of the prior art was tested by dosing an aqueous $H_2O_2$ solution into compartment 7, at a feed rate of 2.5 ml $H_2O_2$/kg laundry.

This prior art system was tested using two different temperatures in compartment 7, viz.:

45° C. (in comparative example A), respectively

85° C. (in comparative example B)

Subsequently, the system of the invention tested in Example 1, was again tested using the same test cloths as those used in the above comparative examples.

For these tests, the types of test cloth used in Example 1 were again used as test monitors. In addition, the following test cloths were also used:

Non-specific soil activity:Empa-104, WFK-10D

Bleachable soil activity:BC/PC-1

Enzyme effect on proteinaceous soil: Veko.

It is noted that Veko and BC/PC-1 are standard available from TNO, Netherlands respectively CFT, Netherlands.

After a full cleaning cycle in the CBW, reflectance measurements were carried out on these test monitors using a standard Micromatch 2020 at a frequency of 460 Nm with a standard light source.

The following results—in terms of percentage light reflected by the test test monitors, at 460 Nm—were obtained:

| Example | A | B | 2 |
|---|---|---|---|
| Temperature of compartment 7 (° C.) | 45 | 85 | 45 |
| Non-specific soil activity: | | | |
| Empa-101 | 50.2 | 54.8 | 46.7 |
| WFK-20D | 59.5 | 59.9 | 54.5 |
| Empa-104 | 49.6 | 54.5 | 43.7 |
| WEK-10D | 74.6 | 79.3 | 69.8 |

-continued

| Example | A | B | 2 |
|---|---|---|---|
| Bleachable soil activity: | | | |
| Sunak | 50.2 | 60.1 | 61.5 |
| BC-1 | 46.1 | 53.7 | 56.2 |
| Empa-114 | 66.7 | 74.7 | 75.0 |
| BC/PC-1 | 55.5 | 61.9 | 64.8 |
| Enzyme effect on proteinaceous soil: | | | |
| Empa-116 | 38.6 | 49.3 | 49.8 |
| Empa-117 | 28.3 | 47.5 | 44.0 |
| AS-10 | 55.0 | 69.3 | 61.3 |
| PC-10 | 60.3 | 77.4 | 71.9 |
| Veko | 57.4 | 63.5 | 66.3 |
| Blood stain removal activity: | | | |
| Empa-111 | 81.2 | 88.2 | 86.2 |

It can be noticed that—apart from its non-specific soil activity—the system of the invention tested in Example 2 shows a performance which is similar or better than those of the prior art systems of Examples A/B.

In this connection, it is noted that although the non-specific soil activity of the system of the invention is somewhat less than that of the prior art systems, it is still adequate for obtaining a good overall cleaning performance.

What is claimed is:

1. A method of laundrywashing in a multi-tank or singletank laundry washing machine, comprising the steps of:

(i) formulating at least two separate components of a chemical cleaning system for aqueous dissolution or dilution to respective use concentrations, a first component comprising a proteolytic enzyme, and a second component comprising an imidoperoxycarboxylic acid having the formula (I)

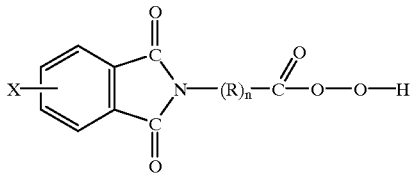

wherein X is H, a halogen or a carboxyl group in any position on the aromatic ring; R is a straight or branched chain lower alkylene having 1–4 carbon atoms; and n is an integer in the range from 1–12;

(iii) introducing the first component into a prewash zone or step, to clean dirty laundry wherein the temperature applied in the prewash zone or step into which the first component is introduced, is in the range of 30–40° C.;

(iv) introducing the second component into a main wash zone or step, to effectively complete the cleaning of the laundry wherein the temperature applied in the main wash zones or steps is in the range of 30–70° C.

2. The method according to claim 1, wherein the pH applied in the main wash zones or steps is in the range of 7–10.

3. The method according to claim 1, wherein the pH applied in the prewash zone or step into which the first component is introduced, is in the range of 9–11.

* * * * *